US005607056A

United States Patent [19]

Whiteside

[11] Patent Number: 5,607,056

[45] Date of Patent: Mar. 4, 1997

[54] TRANSIT PACKAGING HAVING REDUCED CONTENT

[75] Inventor: G. Michael Whiteside, Barrie, Canada

[73] Assignee: Macro-Systems Packaging Ltd., Barrie, Canada

[21] Appl. No.: 433,848

[22] Filed: May 2, 1995

[51] Int. Cl.[6] ..... B65D 65/00; B65D 75/00; B65B 21/00

[52] U.S. Cl. ..... 206/427; 206/429; 206/434; 206/460; 206/813; 53/398; 53/399; 53/176

[58] Field of Search ..... 206/427, 429, 206/434, 460, 423, 813; 53/48.6, 48.9, 48.8, 398, 399, 449, 176, 590, 589, 582

[56] References Cited

U.S. PATENT DOCUMENTS

| | | | |
|---|---|---|---|
| 2,359,297 | 10/1944 | Brogden | 206/434 |
| 2,578,583 | 12/1951 | O'Brien . | |
| 2,744,624 | 5/1956 | Hoogstoel et al. | 206/460 |
| 2,810,476 | 10/1957 | Guyer | 206/427 |
| 2,913,105 | 11/1959 | Brunsing | 206/429 |
| 3,239,994 | 3/1966 | Etzel et al. | 53/48.6 |
| 3,474,901 | 10/1969 | Viater | 206/427 |
| 3,734,280 | 5/1973 | Amneus et al. . | |
| 3,826,357 | 7/1974 | Roth . | |
| 3,883,067 | 5/1975 | McGlynn et al. | 229/939 |
| 3,917,066 | 11/1975 | Cloyd . | |
| 3,986,611 | 10/1976 | Dreher . | |
| 4,033,454 | 7/1977 | Santoni . | |
| 4,050,579 | 9/1977 | Gorski et al. | 206/460 |
| 4,295,568 | 10/1981 | Orpen . | |
| 4,314,633 | 2/1982 | Oliff . | |
| 4,387,808 | 6/1983 | Dombusch | 206/427 |
| 4,441,611 | 4/1984 | Sommariva . | |
| 4,471,870 | 9/1984 | Uhlig . | |
| 4,625,864 | 12/1986 | Nigrelli | 206/427 |
| 4,757,896 | 7/1988 | Klein . | |
| 4,787,509 | 11/1988 | Pasternickl . | |
| 4,821,880 | 4/1989 | Ditton . | |
| 4,930,633 | 6/1990 | Gloyer | 206/427 |
| 4,936,450 | 6/1990 | Paul . | |
| 4,956,961 | 9/1990 | Janhonen | 53/176 |
| 4,998,615 | 3/1991 | Bryan . | |
| 5,188,225 | 2/1993 | Jorba . | |

FOREIGN PATENT DOCUMENTS

| | | | |
|---|---|---|---|
| 1191819 | 8/1985 | Canada . | |
| 1208144 | 7/1986 | Canada . | |
| 2085792 | 6/1993 | Canada . | |
| 2836533 | 2/1980 | Germany | 206/460 |
| 4010060 | 5/1994 | WIPO | 206/429 |

*Primary Examiner*—Marie D. Patterson
*Attorney, Agent, or Firm*—Jeffrey T. Imai; Arne I. Fors; D. Doak Horne

[57] ABSTRACT

A transit packaging having a reduced content includes a blank of a corrugated cardboard having flutes in a longitudinal direction. A first and second transverse score are made at opposite end regions of the blank defining side panels of the packaging. A plurality of longitudinally aligned pairs of notches are at opposite ends of the blank. A retainer releasably retains like containers onto the blank preventing relative sliding movement. A plurality of straps, each positioned in one of the aligned pairs of notches, wraps about the blank when the like containers are retained on the blank.

16 Claims, 5 Drawing Sheets

FIG. 6.
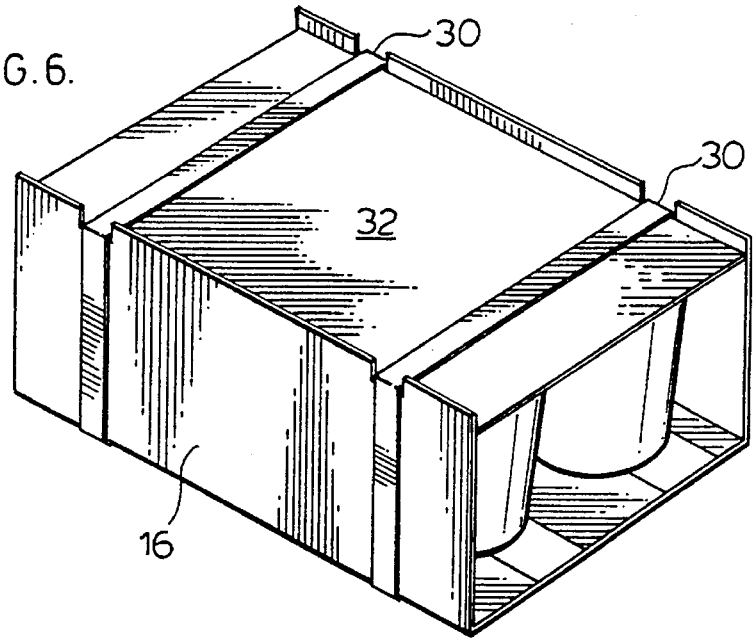
FIG. 7.
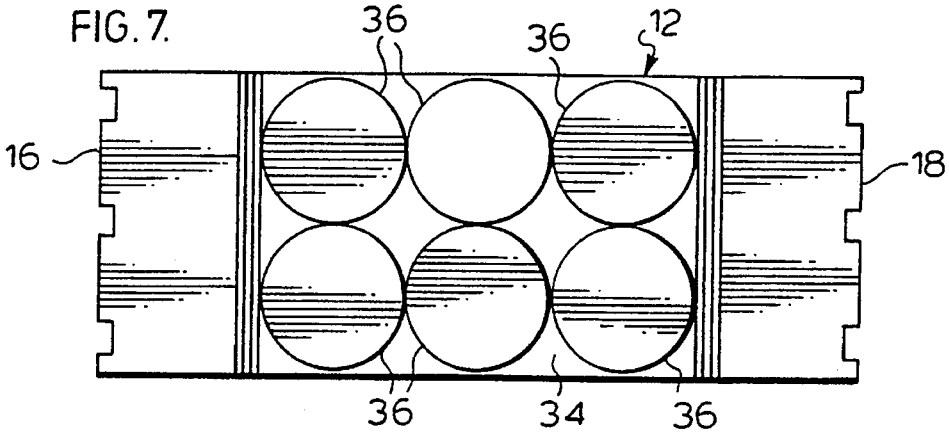
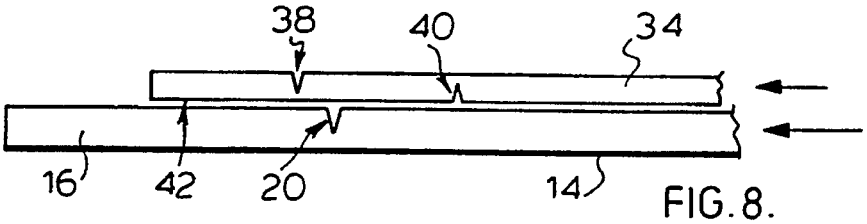
FIG. 8.
FIG. 9.
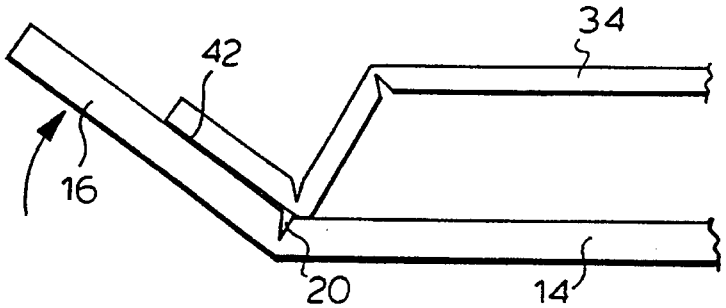

FIG.10.
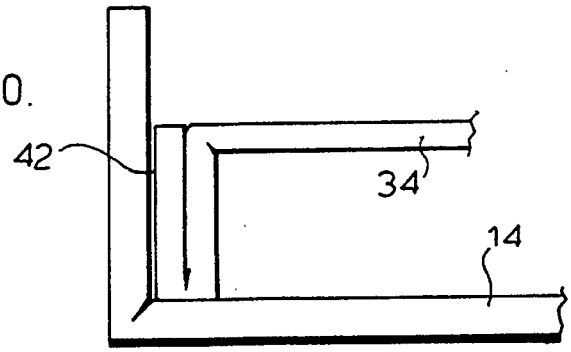
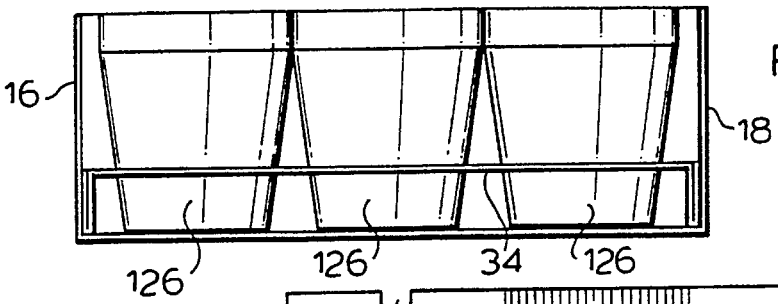
FIG. 11.
FIG.12.
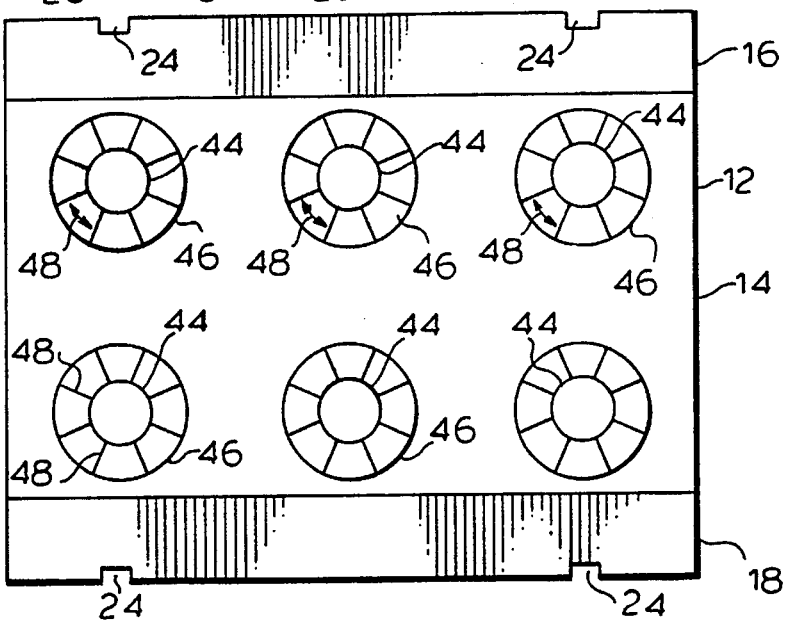
FIG.13.
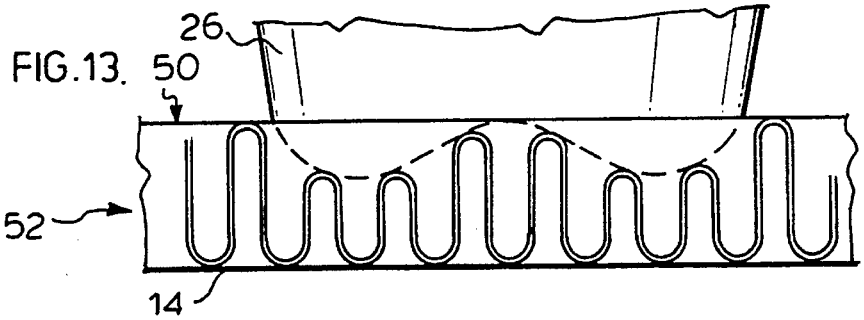

TRANSIT PACKAGING HAVING REDUCED CONTENT

FIELD OF INVENTION

This invention relates to transit packaging having a reduced content. In particular, this invention relates to transit packaging for tapered containers, namely thin walled plastic containers, bowl shaped containers or glass containers shipped in a multi-pack format.

BACKGROUND OF INVENTION

Tapered containers, namely thin walled plastic containers, bowl shaped containers and glass containers are widely used in the food industry. In particular, edible oil products such as margarine and whipped toppings are currently packaged in bowl shaped containers. These containers must be packaged for transit in a multipack format. The multi-pack format requires outer packing support for loading onto pallets. Full corrugated boxes are normally used to package bowl shaped containers for transit.

There is an ongoing trend to reduce total package content by 10%. Currently, two U.S. states have enacted laws requiring 10% package reductions.

Current attempts at package reductions merely replaces the corrugated boxes with trays on which the containers are nested and then shrink wrapping the unit. However, a problem is created regarding the structural integrity of the trays. Such trays are generally not self-supportive when loaded onto pallets resulting in the pallet loads being unstable. With unstable pallet loads, there is a higher rate of damage during transit.

Shrink wrapping is not energy efficient. Extensive energy is required to heat the wrap. Much of the energy is lost as heat.

U.S. Pat. Nos. 3,826,357 and 4,998,615 are examples of packaging which addresses the structural problem. Dividers or stacker elements are required to be used in order to improve the stackability of the packages. By adding dividers and stacker elements, significant improvements in packaging reductions cannot be achieved.

Canadian Patent No. 1,191,819, describes a multipackage assembly is described. The packages are sandwiched between two sheet of cardboard and held together by strips of a frangible adhesive. This type of packaging has met the requirements of reduced packaging. However, this type of packaging is only suitable for regular parallelepiped cartons. Tapered containers packaged in this type of packaging are flimsy and do not handle and stack well.

In still other types of packaging such as described in U.S. Pat. No. 4,787,509, yogurt containers are wrapped with a single sheet of cardboard and attached to the sheet by a frangible adhesive. This type of packaging is only capable of packaging a small number of containers in a single package.

SUMMARY OF THE INVENTION

The disadvantages of the prior art may be overcome by providing a transit packaging which has a reduced content which also provides structural integrity for maintaining stable pallet loads.

It is desirable to provide a transit package comprising a cardboard sheet which extends partially about a plurality of containers. The sheet has a base and two ends with a plurality of straps which wrap about the sheet and containers forming an integral and structural package.

It is further desirable to provide a transit packaging which also includes a top sheet of cardboard for overlying the containers and which is wrapped by straps.

It is further desirable to provide a means for retaining the containers onto the cardboard sheet to prevent sliding movement.

It is further desirable to provide a frangible adhesive for releasably retaining the containers onto the cardboard sheet.

It is further desirable to provide a spacing retainer sheet to retain the containers onto the cardboard sheet.

It is still further desirable to provide an indentable footprint on the cardboard sheet to receive containers and once the containers are impressed onto the footprint sliding movement of the containers is prevented.

According to one aspect of the invention, there is provided a transit packaging comprising a blank of a corrugated cardboard having flutes in a longitudinal direction and having opposed end panels foldable to extend in the same direction and substantially perpendicular to the blank, a retainer for retaining like containers onto the blank in a rectangular pattern between the end panels, and a plurality of straps for wrapping about the blank once the like containers are presented to the retainer means and the end panels are folded. The plurality of straps urge at least outer longitudinal columns of the like containers together forming a structural package.

According to one aspect of the invention, there is provided a transit packaging comprising a blank of a corrugated cardboard having flutes in a longitudinal direction, a first and second transverse score at opposite end regions of the blank defining end panels of the packaging, a plurality of longitudinally aligned pairs of notches at opposite ends of the blank, a retainer means on the blank, the retainer means for retaining like containers onto the blank preventing relative sliding movement, and a plurality of straps, each positioned in one of the aligned pairs of notches, for wrapping about the blank when the like containers are retained on the blank.

According to another aspect of the invention, there is provided a method of packaging like containers using a blank of a corrugated cardboard. The blank has flutes in a longitudinal direction, opposed end panels foldable to extend substantially parallel to each other and a plurality of longitudinally aligned pairs of notches at opposite ends of the blank. The method comprises the steps of retaining like containers onto the blank in a rectangular pattern between the opposed end panels, plowing the end panels upwardly, and wrapping a plurality of straps about the blank with each of the straps positioned in one of the aligned pairs of notches.

DESCRIPTION OF THE DRAWINGS

The present invention will be better understood and more particularly described in the detailed description below and the following figures:

FIG. 6 is an illustration of a perspective view of a 2×3 transit packaging of the second embodiment.

FIG. 7 is an illustration of a top view of a third embodiment of the transit packaging of the present invention.

FIG. 8 is an illustration of a partial side view of a blank and retainer sheet of the embodiment in FIG. 7.

FIG. 9 is an illustration of a side view of a blank and retainer sheet of the embodiment of FIG. 7 as the end panel is plowed upwards.

FIG. 10 is an illustration of a side view of a blank and retainer sheet of the embodiment of FIG. 7 with the end panel folded upwards.

FIG. 11 is an illustration of a side view of the embodiment of FIG. 7 in the folded position.

FIG. 12 is an illustration of a top view of a blank of a fourth embodiment of the transit packaging of the present invention.

FIG. 13 is an illustration of a cross-sectional view of transit packaging of the embodiment of FIG. 12 with a container placed in the base member.

DETAILED DESCRIPTION OF THE INVENTION

Figure 1:
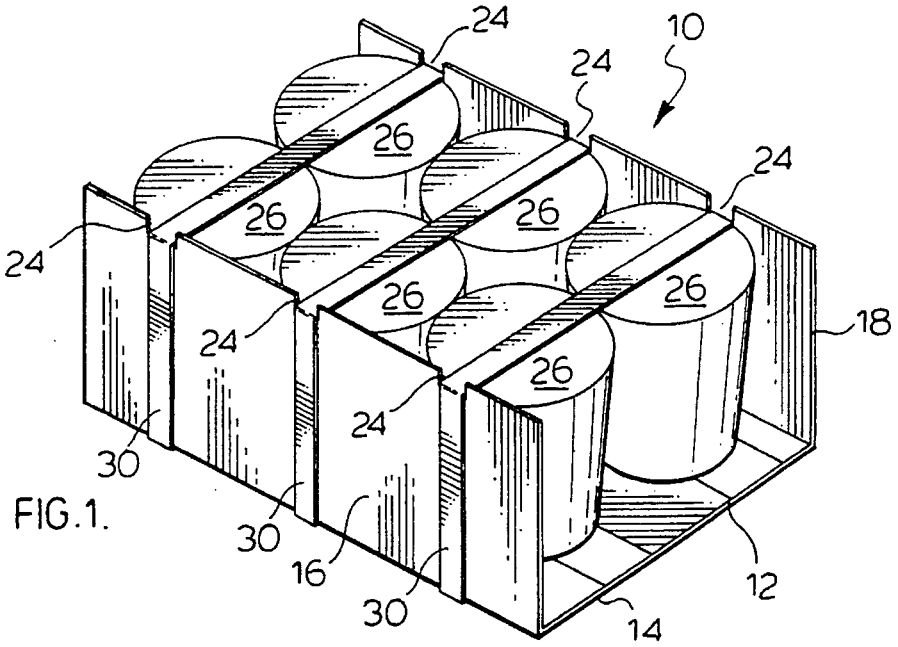
FIG. 1 is an illustration of a perspective view of a first embodiment of the transit packaging of the present invention in a packaged condition.

The transit packaging of the present invention is generally illustrated in FIG. 1 as 10. The packaging comprises a blank 12 having a base member 14 and two end panels 16 and 18.

Figure 2:
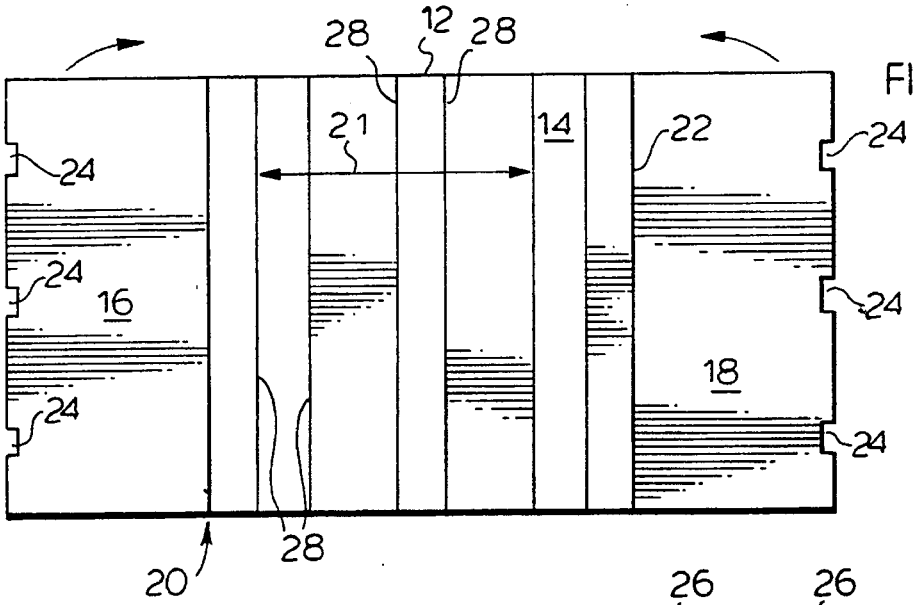
FIG. 2 is an illustration of a top view of the blank for the transit packaging of the embodiment of FIG. 1 in an unfolded flat condition.

Referring to FIG. 2, the blank 12 is illustrated in a flat condition. The central portion comprises the base member 14 while the end portions make up the end panels 16 and 18. At each end region of the blank 12, between base portion 14 and end panel 16 is score 20, and between base portion 14 and end panel 18 is score 22. Scores 20 and 22 are applied in a conventional manner.

Blank 12 is preferably made of corrugated cardboard. Corrugated cardboard has a longitudinal direction 21, which is the direction of the flutes or internal reinforcing member. In order to maintain structural integrity of the packaging, the longitudinal direction should be in a direction from end panel 18 to base member 14 to end panel 16. Scores 20 and 22 should be in a transverse direction perpendicular to the longitudinal direction.

End panels 16 and 18 are provided with a plurality of aligned pairs of notches 24. The distance between the base of each notch 24 and score 20 and score 22 is approximately equal to the height of the containers 26. The end panels 16 and 18 have a height when folded upwards greater than the height of the containers 26.

Containers 26 are like containers which are used to package foodstuffs, such as edible oil products and whipped toppings. The containers are generally characterized by a bowl shaped tapered bottom.

In the first embodiment, in FIGS. 1–4 the blank 12 of the transit packaging comprises a plurality of strips 28 of a frangible thermo-adhesive applied to blank 12.

Containers 26 are arranged on base member 14 in a rectangular pattern or array of rows and columns, wherein rows are in the transverse direction and columns are in the longitudinal direction. Since containers 26 are like in shape and have a tapered bowl shape, only the tops or lids of each containers 26 abut one another.

Strips 28 retain the containers 26 onto blank 12 preventing lateral or sliding movement.

Figure 3:
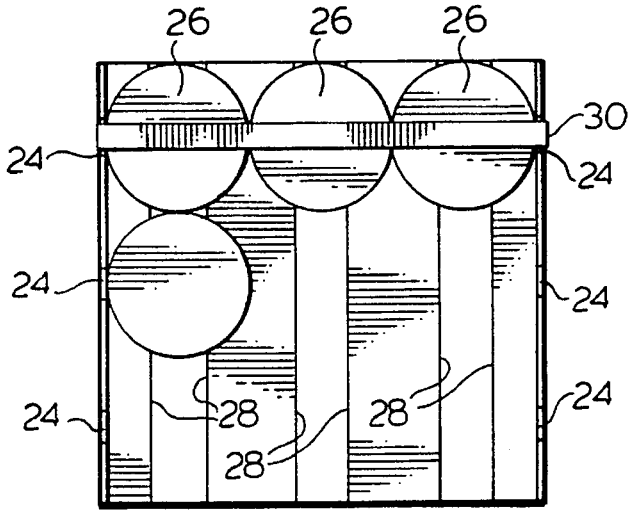
FIG. 3 is an illustration of a top view of the transit packaging of the embodiment in FIG. 1, partially filled.

Referring to FIG. 3, the end panels 16 and 18 are plowed upwardly about scores 20 and 22, respectively, until substantially perpendicular to the base member 14. The aligned notches 24 on end panels 16 are in alignment with the aligned notches on end panel 18. The number of aligned notches 24 in end panels 16 and 18 is normally equal to the number of columns of containers 26.

Straps 30 are then wrapped about the package and positioned to rest in two aligned notches 24 of end panels 16 and 18 and tightened to firmly retain containers 26 on the base member 14. Notches 24 prevent the straps 30 from slipping or moving.

The number of straps is preferably equal to the number of columns of containers 26.

Figure 4:
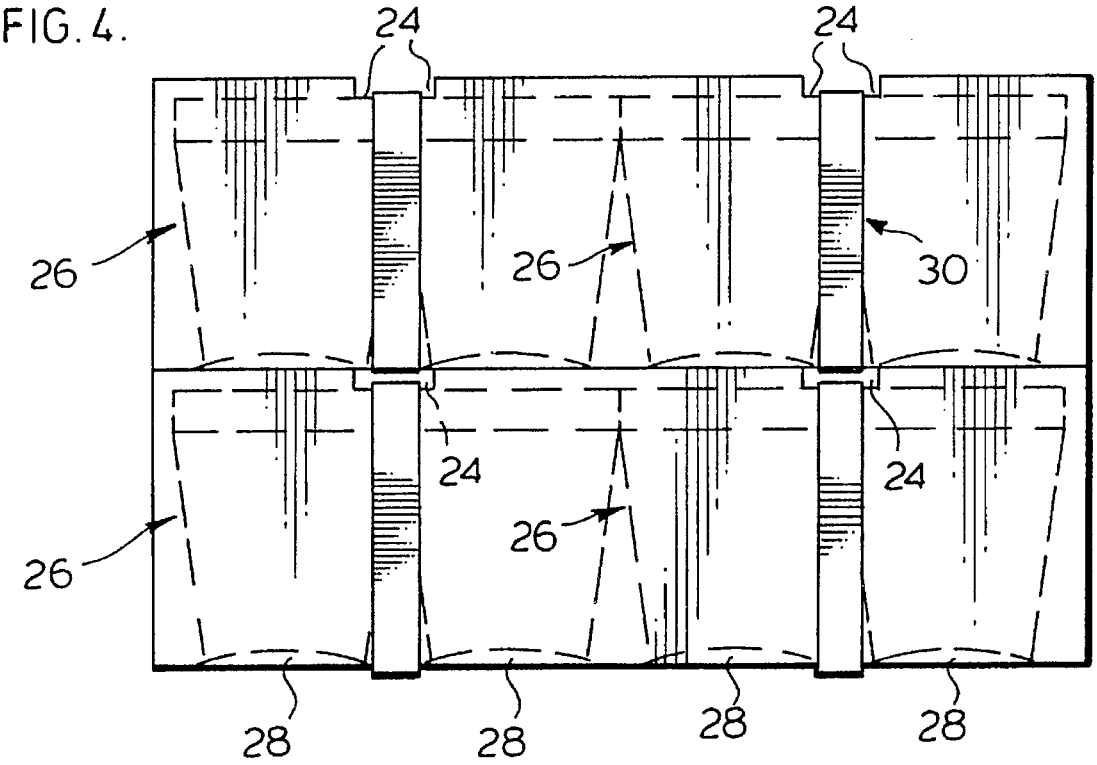
FIG. 4 is an illustration of a side view of two transit packagings of the embodiment in FIG. 1, stacked one upon the other with cut out lines illustrating like containers.

Referring to FIG. 4, once strapped together, the group of containers 26 is ready for loading onto pallets and ready for transport. The packaging 10 provides sufficient strength or structural integrity such that like packages may be stacked one upon another. The strips of adhesive 28 retain the individual containers onto the base member 14 preventing the containers 26 from slipping out.

The quantity of packaging of the present invention is dramatically reduced from the prior art carton method of packaging for transit. The structural integrity is maintained minimizing damage during transit.

Figure 5:
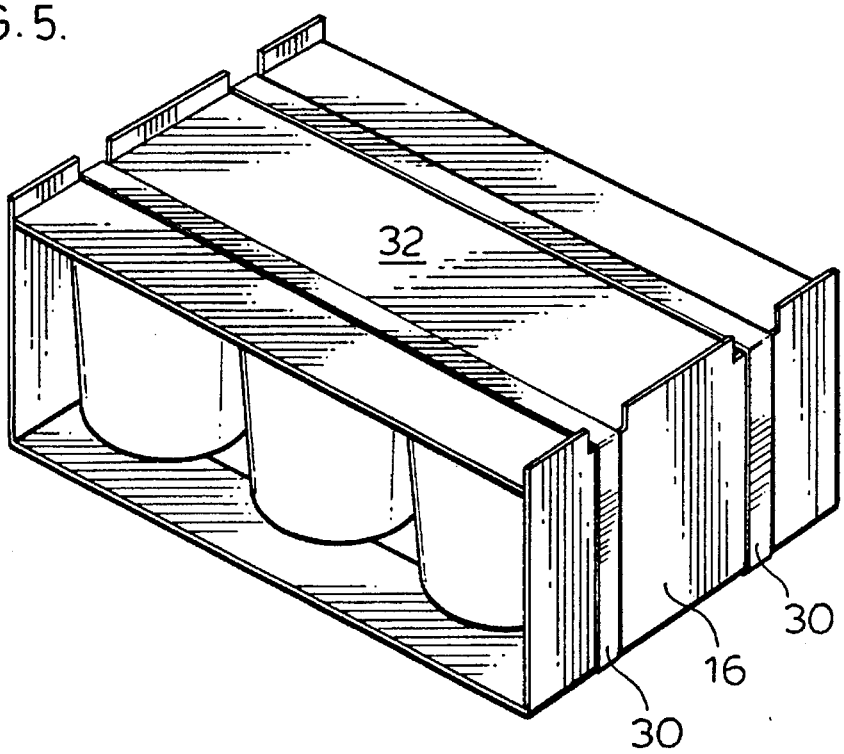
FIG. 5 is an illustration of a perspective view of a second embodiment of a 3×3 transit packaging of the present invention.

Referring to FIGS. 5 and 6, a second embodiment is illustrated. In the second embodiment, the blank 12 is identical to the blank of the first embodiment. A top panel 32 is placed over the containers 26 prior to strapping straps 30 about the packaging. The top panel can be made from corrugated cardboard, cardboard, paper board or fiber board.

When a top panel 32 is used and the number of columns is greater than 2, it is possible for the number of straps to be alternated with the number of columns, but keeping straps for each outer column. In this case, the amount of packaging can be reduced by a number of straps.

For example in FIG. 5, an array of containers in a 3×3 package is illustrated with only two straps 30. In FIG. 6, a 3×2 package is illustrated, again with only two straps 30.

Referring now to FIGS. 7 to 11, a base having an alternate retainer is illustrated. The blank 12 has a retainer sheet 34 adhered between end panel 16 and end panel 18. Retainer sheet 34 has a plurality of holes 36 or openings corresponding to the number of containers to be packaged. In the illustrated packaging, six containers are to be packaged and therefore retainer sheet 34 has six punched holes or openings 36.

Each end of retainer sheet 34 has two scores 38 and 40 extending in a transverse direction. The two scores 38, 40 are applied from opposite sides of the retainer sheet 34. When retainer sheet 34 is adhered to end panel 16 at 42, scores 38, 40 will straddle score 20. Similarly for the opposite end, scores 38, 40 will straddle score 22.

As illustrated in FIGS. 9 and 10, as end panel 16 is plowed upwardly, blank 12 will bend along score 20. The opposite scores 38, 40 will bend, spacing retainer sheet 34 from base member 14. In this condition, containers 126 may be inserted into holes or openings 36 and will be prevented from sliding relative to the base member 14. The containers 126 are then strapped, either with or without a top panel, with straps 30 to present a structural package.

Alternatively, the containers 126 may be placed on the base member 14 in holes or openings 36. The thickness of the spacing retainer sheet 34 will prevent the containers 126 from sliding. The end panels 16 and 18 are plowed upwardly, retainer sheet 34 folds and becomes spaced from the base member 14 sliding relative to the containers 126 for retaining the containers within the openings. The containers 126 are then strapped, either with or without a top panel, with straps 30 to present a structural package.

The packaging of FIGS. 7 to 11 is particularly useful for containers relatively taller than containers 26. Containers 126 may be glass containers with a tapered shape.

Referring to FIGS. 12 and 13, a further embodiment of a transit packaging having a retainer for retaining a container relative to the base member is illustrated. In this embodiment, the base member 14 of blank 12 is provided with a plurality of footprints which corresponds to the shape of the base of the container to be packaged. In the case of the bowl shaped containers 26, the footprint comprises two concentric circular scores 44 and 46 and a plurality of radially extending kiss cuts 48.

Referring to FIG. 13, as container 26 is urged downwardly, the kiss cuts 48 will allow the base of container 26 to contour the upper layer 50 of base member 14 pressing upon the corrugated layer 52 of base member 14, the footprint becomes indented to complementarily receive the base of container 26 thereon.

A container 26 is placed on each of the footprints and then the end panels 16 and 18 are plowed upwardly, ready for strapping, either with or without a top panel, with straps 30 to present a structural package.

Figure 14:
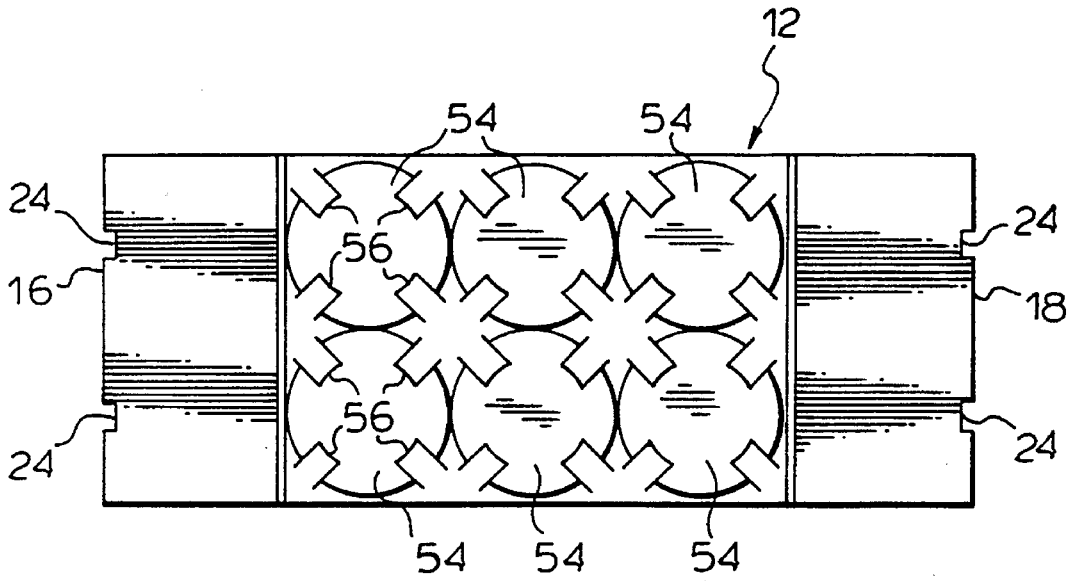
FIG. 14 is an illustration of a top view of a blank of a fifth embodiment of the transit packaging of the present invention. (Although seveal emobodiements are illustrated, like references refer to like parts of the figures).

Referring to FIG. 14, a further embodiment is illustrated. In this embodiment, the blank 12 has a retainer comprising a regular pattern of holes 54. Each hole has a plurality of tabs 56 which extend inwardly of the hole 54. The die cuts wich define the tab extend outwardly of the radius of hole 54.

In use, the containers 26 or 126 are placed on the hole 54. The ends 16 and 18 are plowed upwardly. The containers 26 or 126 will extend through the holes and frictionally engage tabs 56 retaining the containers 26 or 126 onto blank 12.

The packages 10 of the present invention are loaded onto pallets. The pallet loads can optionally be wrapped with a shrink wrap to protect the pallet load from damage. The pallet load is shipped to the desired destination. The packages 10 may be unloaded and transported to the retail destination. At the retail destination, the packages 10 may be stacked on a shelf and then the straps 30 may be cut and removed. Since the containers 26, 126 are retained on the base member 14, the packages 10 may still be maneuvered without upsetting the containers 26, 126. One of the end panels 16, 18 may be cut away exposing the face of the containers 26, 126. Alternatively, the packages 10 may be stacked and presented from the end where the containers 26, 126 are exposed.

The containers 26, 126 may be removed by the consumer. If the adhesive strips 28 are used, the adhesive is frangible allowing easy removal. If the spacing retainer sheet 34 is used the containers 126 may be removed from openings 36. If the footprints 44, 46, 48 are used, the containers are not attached to the base member and can be removed therefrom.

It is now apparent to a person skilled in the art that the transit packaging of the present invention could be readily modified. It is understood that certain changes in style, size and components may be effective without departure from the spirit of the invention and within the scope of the appended claims.

I claim:

1. A transit packaging in combination with like containers having uniform height, shape and size, said like containers each having tapered sides, a top and a bottom, said transit packaging comprising a blank of a corrugated cardboard having flutes in a longitudinal direction and having scores defining foldable opposed end panels wherein said opposed panels are foldable to extend substantially perpendicular to said blank, said end panels each has a height when folded greater than said height of said like containers, said end panels have a plurality of longitudinally aligned pairs of notches at opposite end edges of said blank, each of said notches has a base spaced from a nearest one of said scores a distance substantially equal to said height of said like containers, retainer means for retaining said like containers onto said blank in a rectangular pattern of rows and columns in a side by side relation, each of said columns extending longitudinally and each of said pairs of notches in alignment with one of said columns, and a plurality of straps each positioned in one of said pairs of notches and wrapped about said blank and on top of said like containers urging columns of said like containers together and retaining said end panels in said perpendicular condition, forming a structural package.

2. A transit packaging as claimed in claim 1 wherein said retainer is frangible adhesive, applied to said blank.

3. A transmit packaging as claimed in claim 2 wherein said frangible adhesive is arranged in a plurality of strips.

4. A transit packaging as claimed in claim 3 wherein said strips are applied to the blank substantially parallel to each other.

5. A transit packaging as claimed in claim 1 wherein said retainer means is a plurality of holes in said blank, each hole having a size for frictionally receiving one of said like containers.

6. A transit packaging as claimed in claim 1 wherein said retainer means is a plurality of footprints in said blank, each of said footprints having means for indenting for complementarily receiving a base of said like containers.

7. A transit packaging as claimed in claim 1, wherein said retainer means is a foldable sheet having a plurality of holes, said sheet attached to said end panels, said foldable sheet comprising means for folding said foldable sheet and becoming spaced from said blank sliding relative to said like containers for retaining said like containers within said holes.

8. A transit packaging as claimed in claim 1 wherein said transit packaging further includes a top panel for covering said like containers prior to wrapping said blank with said plurality of straps.

9. A transit packaging as claimed in claim 8 wherein said top panel is selected from a group consisting of:

corrugated cardboard, cardboard, paper board and fiber board.

10. A method of packaging like containers using a blank of a corrugated cardboard having flutes in a longitudinal direction, scores defining opposed end panels foldable to extend substantially parallel to each other and a plurality of longitudinally aligned pairs of notches at opposite end edges of said blank, said like containers having uniform height, shape and size and each having tapered sides, a top and a bottom, said method comprises the steps of retaining a plurality of like containers onto the blank in a rectangular pattern of rows and columns in a side by side relation, each of said columns in substantial alignment with said pair of notches, plowing said end panels upwardly to extend substantially perpendicular to said blank and to align a base of each of said notches with tops of said like containers, and positioning a strap in each one of said aligned pairs of notches, tensioning each of said straps about said blank and on top of said like containers thereby urging columns of said like containers together and retaining said end panels is said perpendicular condition.

11. A method as claimed in claim 10 wherein said step of retaining includes the step of applying a frangible adhesive to a base portion of said blank and applying said like containers thereto.

12. A method as claimed in claim 11 wherein said frangible adhesive is applied in strips.

13. A method as claimed in claim 10 wherein said step of retaining includes the step of punching holes in said blank, each of said holes being sized to frictionally receive said like containers and inserting said like containers therein.

14. A method as claimed in claim 13 wherein each of said holes is punched leaving a tab for engaging said like containers.

15. A method as claimed in claim 10 wherein said method further includes the step of applying a top panel to cover said like containers prior to said wrapping step.

16. A method as claimed in claim 10 wherein said step of retaining includes attaching a foldable sheet having a plurality of holes to said end panels whereby during said step of plowing said end panels, said foldable sheet folds and becomes spaced from said blank containers for retaining said like containers within said holes.

* * * * *